US005722887A

United States Patent [19]

Wolfson et al.

[11] Patent Number: 5,722,887

[45] Date of Patent: Mar. 3, 1998

[54] AUTOMATIC PROGRAM VENTILATION CONTROL SYSTEM

[75] Inventors: Jason Wolfson, Duxbury; Paul H. Raymer, Falmouth, both of Mass.

[73] Assignee: Tamarack Technologies, Inc., West Wareham, Mass.

[21] Appl. No.: 516,382

[22] Filed: Aug. 17, 1995

[51] Int. Cl.[6] ..... H01H 43/04

[52] U.S. Cl. ..... 454/256; 200/297; 200/314; 340/309.15; 968/977

[58] Field of Search ..... 200/293, 297, 200/314; 968/977; 340/309.15; 454/229, 239, 256

[56] References Cited

U.S. PATENT DOCUMENTS 4,344,000 8/1982 Schornack et al. ..... 340/309.1 X 4,360,739 11/1982 Goldstein ..... 200/293 X 5,189,412 2/1993 Mehta et al. ..... 340/825.22

*Primary Examiner*—Harold Joyce

*Attorney, Agent, or Firm*—Iandiorio & Teska

[57] ABSTRACT

An automatic programmed ventilation control system for operating a fan includes a fan drive circuit; a duty, cycle control circuit including means for selecting a duty cycle and means for setting the selected duty cycle; a timing circuit including means for selecting the time of day and means for setting the selected time of day; a fan speed control circuit including means for selecting a fan speed and means for setting the selected fan speed; and a manual override switch circuit for overriding the set duty cycle and fan speed for operating the fan at a predetermined speed for a preselected period of time.

6 Claims, 5 Drawing Sheets

AUTOMATIC PROGRAM VENTILATION CONTROL SYSTEM

FIELD OF INVENTION

This invention relates to an automatic programmed ventilation control system for a fan, and more particularly to such a system which is tamper-proof but subject to limited user control.

BACKGROUND OF INVENTION

Air quality in buildings and homes, e.g., mobile homes, has become a more serious problem with the trend toward more tightly sealed, energy efficient construction. To compensate for this, ventilation fans are needed to run for longer periods, and quietly, for noisy fans are purposely turned off to end the annoyance causing ventilation to suffer. The standard practice has been to mount ventilation fans in the ceiling but the only adequate, quiet fans are side vented which called for extensive re-ducting and moving of the roof cap so that the side mounted fan can still vent through the roof. This is difficult and expensive. Since people cannot usually detect when the ventilation has deteriorated below safe levels, standards have been set for how often and for how long each day that the system should operate. For example, one standard is to operate the fan from 6:00 PM to 6:00 AM at least five minutes per hour. There are also standards for the amount of flow required for safe and healthy air exchange. Bigger homes and buildings require higher flow rates to accomplish suitable air exchange; thus different size fans are required for different size premises. Timers used to control ventilation include crank timers and pin timers. Crank timers are activated by twisting a knob which winds up a spring, allowing the device to run for a preset amount of time. Crank timers provide an immediate cycling control, turning on the fan when the knob is released and are useful as a one shot, ventilation control. There are some complaints about the ticking sound, however, and they cannot be used to control a full time, safe controlled ventilation system. Pin timers are clock timers with a series of pins which can be pulled out or set to provide multiple on or off periods throughout a day. The clock runs on the AC line frequency, running accurately as long as there is AC power running though the clock. After a power failure, however, the clock motor simply continues to run from where it stopped. One of the problems with pin timers is that people annoyed with the noise or concerned about the cost associated with a running fan, pull the pins on the pin timer to disable the system. Such pin timers also often require special cover plates and mounting boxes further increasing costs.

SUMMARY OF THE INVENTION

It is therefore an object of this invention to provide an improved ventilation control system.

It is a further object of this invention to provide such an improved ventilation control system which is economic and safe.

It is a further object of this invention to provide such an improved ventilation control system which is easy and less expensive to install.

It is a further object of this invention to provide such an improved ventilation control system which enables one fan to be used for a wide range of different size spaces to be ventilated.

It is a further object of this invention to provide such an improved ventilation control system which is quiet in operation and at initial start-up.

It is a further object of this invention to provide such an improved ventilation control system which is not easily defeatable by the unauthorized user after installation.

It is a further object of this invention to provide such an improved ventilation control system which is programmed to be totally automatic.

It is a further object of this invention to provide such an improved ventilation control system which includes a manual override which can operate the fan for a limited period of preset flow at a high flow rate and then return to the automatic programmed operation.

It is a further object of this invention to provide such an improved ventilation control system which has a battery backup to preserve the various settings during power failure.

The invention results from the realization that a tamper proof ventilation control system for insuring proper ventilation but affording increased ventilation on demand can be achieved using a fan whose daily operation and duty cycle are automatically program controlled and therefore free from unauthorized intervention yet offer a manual override to accommodate a user's specific needs.

This invention features an automatic programmed ventilation control system for operating a fan including a fan drive circuit, a duty cycle control circuit including means for selecting a duty cycle and means for setting the selected duty cycle, a timing circuit including means for selecting the time of day and means for setting the selected time of day, and a fan speed control circuit including means for selecting a fan speed and means for setting the selected fan speed. A manual override switch circuit overrides the set duty cycle and fan speed for operating the fan at a predetermined speed for a preselected period of time.

In a preferred embodiment the means for selecting a duty cycle, means for selecting the time of day, and means for selecting a fan speed may all be implemented in the same multiposition switch device. There may also be a control panel and each of the means for setting and the means for selecting may be accessible on the panel. The panel may include means for mounting a switch cover plate which covers and makes inaccessible the panel. The manual override switch circuit may include an override switch which may be accessible through the switch cover plate. The fan drive circuit may include a soft start circuit for incrementally increasing the fan speed to the selected speed. There may also be a battery backup power supply for maintaining the selected duty cycle, speed and time in case of power failure.

DISCLOSURE OF PREFERRED EMBODIMENT

Other objects, features and advantages will occur to those skilled in the art from the following description of a preferred embodiment and the accompanying drawings, in which.

Figure 1:
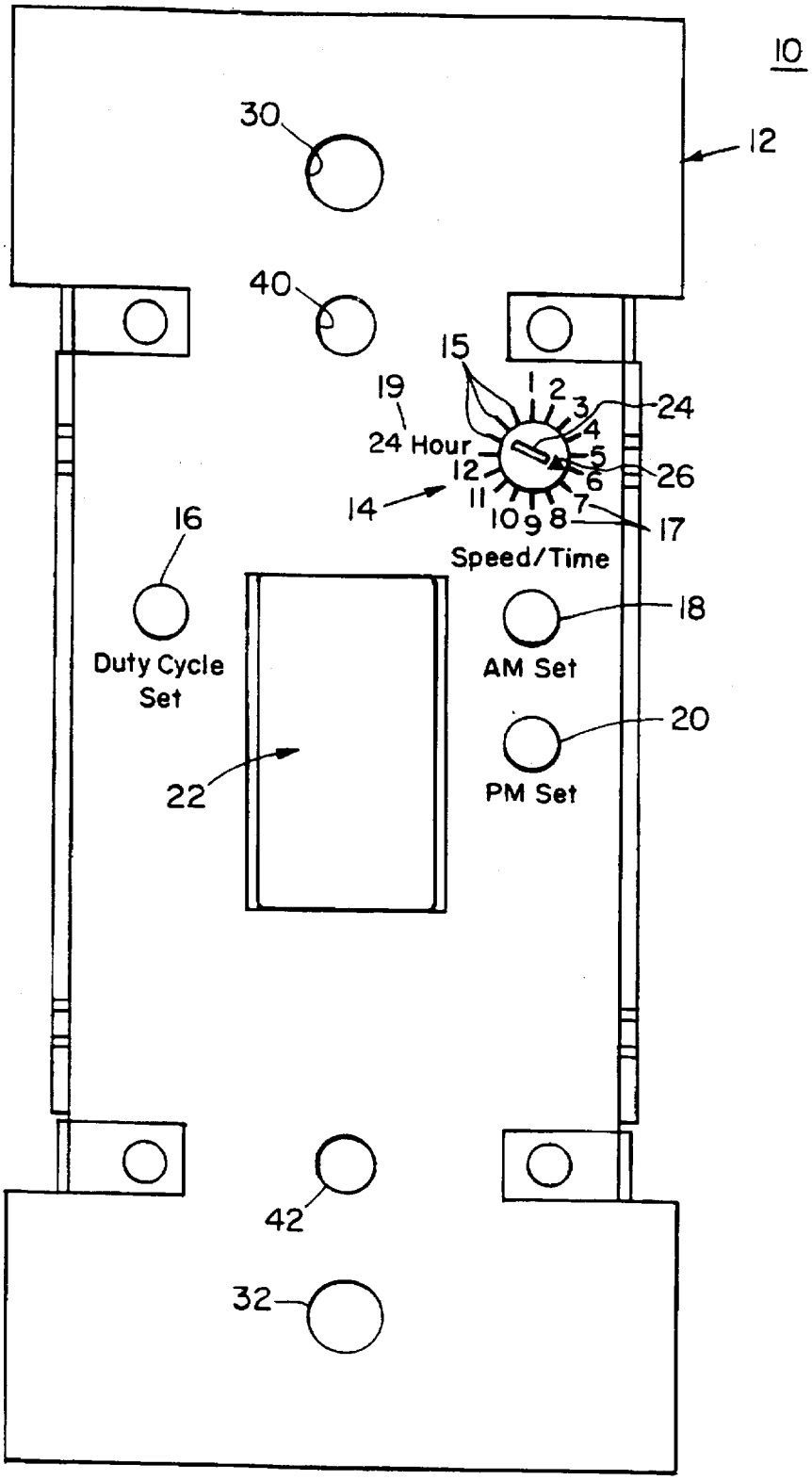
FIG. 1 is a front plan view of a control panel of the automatic programmed ventilation control system according to this invention.

There is shown in FIG. 1 a ventilation control system 10 according to this invention including control panel 12 which includes a multiposition switch 14 with sixteen positions indicated by marks 15, the first twelve of which are numbered 1–12 as shown at 17, and the thirteenth of which, 19, bears the marking "24 Hour". The system automatically operates so that the fan will be off for twelve hours and will operate according to a selected duty cycle for the other twelve hours. If it is desired to have it operate for a full twenty-four hours on the selected duty cycle then the marker arrow 26 is set to the "24 Hour" mark rather than any one of the 1–12 hour marks. System 10 also includes a duty cycle set switch 16, an AM set switch 18, and PM set switch 20, and a manual override button 22.

In operation, multiposition switch 14 may be set to the nearest hour of the time of day by placing a screwdriver in slot 24 and rotating it until the arrow 26 points nearest to the proper hour at the positions 17 designated 1–12. Then either the AM 18 or PM 20 set button is pushed to record the hour and the period of day, AM or PM, that is the present real time. The duty cycle may be set by once again putting a screwdriver tip in slot 24 and again rotating it to one of the twelve numbered positions. Each of the numbers now represents a five-minute interval so that for example if the arrow 26 is set at position 6 that means that the duty cycle will be thirty minutes of on time for every hour. After this selection has been made the duty cycle set switch 16 is actuated to set this duty cycle. Finally, the screwdriver tip may be inserted in slot 24 a third time to aim the arrow 26 at the one of the sixteen positions that represent sixteen different speeds of the fan, 1 being the highest or full speed of the fan, 16 being the lowest speed of the fan.

Manual override switch 22 may be actuated by the homeowner or other user at any time to override the preselected speed and duty cycle and operate the fan for a predetermined time at a predetermined speed setting, for example, at full speed for twenty minutes. After the override time is up the system reverts to operation at the preprogrammed speed and duty cycle.

Figure 2:
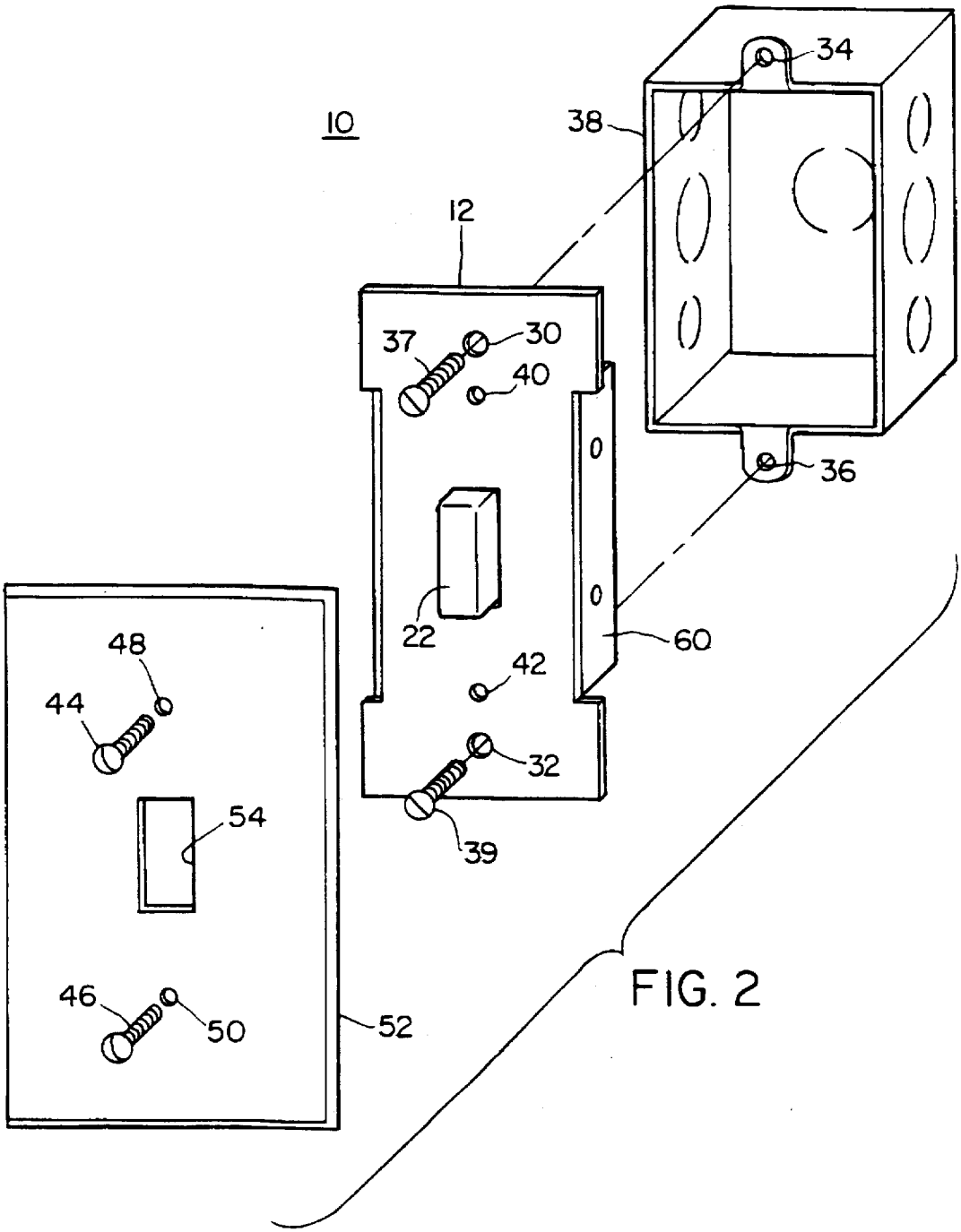
FIG. 2 is an exploded view of the control panel of FIG. 1 with a conventional cover plate and electrical mounting box.

Control panel 12 includes two mounting holes 30, 32 which receive screws 37 and 39 that engage with threads in holes 34, 36, FIG. 2, in a conventional electrical outlet box 38. Control panel 12, FIGS. 1 and 2, also includes two holes 40 and 42 for receiving screws 44 and 46 through holes 48 and 50 in conventional switch cover plate 52 to mount it to panel 12. The conventional recess 54 in cover plate 52 accommodates manual override switch 22 while the rest of the control panel is covered by switch plate 52 and is inaccessible.

Figure 3:
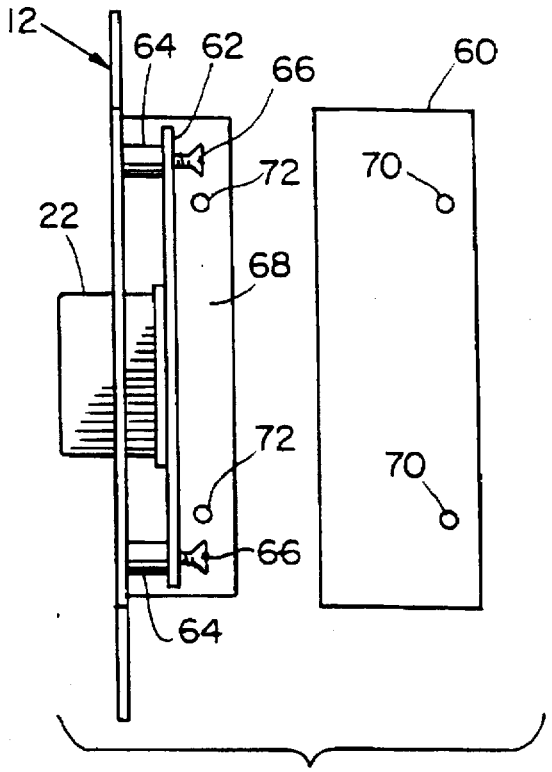
FIG. 3 is a side elevational view of the control panel of FIG. 1 showing the circuit board in the ventilation control system according to this invention and the housing which attaches to the control panel to protect the circuit board.

The circuit which makes up the ventilation control system 10 is contained within housing 60, FIG. 2, which is shown exploded away in FIG. 3 to reveal printed circuit board 62 which contains the circuitry and mounts manual override switch 22. Printed circuit board 62 is mounted on panel 12 by means of standoffs 64 and screws 66. Elongated tabs 68, only one of which is visible in FIG. 3, extend down from the sides of panel 12 so that when housing 60 is in place screws or rivets may be inserted through holes 70 in housing 60 and then through holes 72 in elongated tabs 68 to secure together panel 12 and housing 60.

Figure 4:
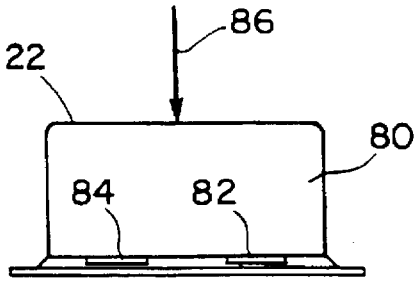
FIG. 4 is a side elevational view of the manual button switch shown in FIGS. 1–3.
Figure 5:
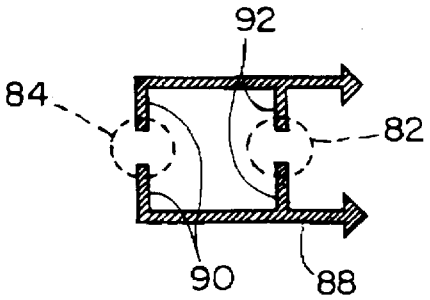
FIG. 5 is a schematic diagram showing the operation of the switching action of the button switch of FIG. 4.
Figure 6:
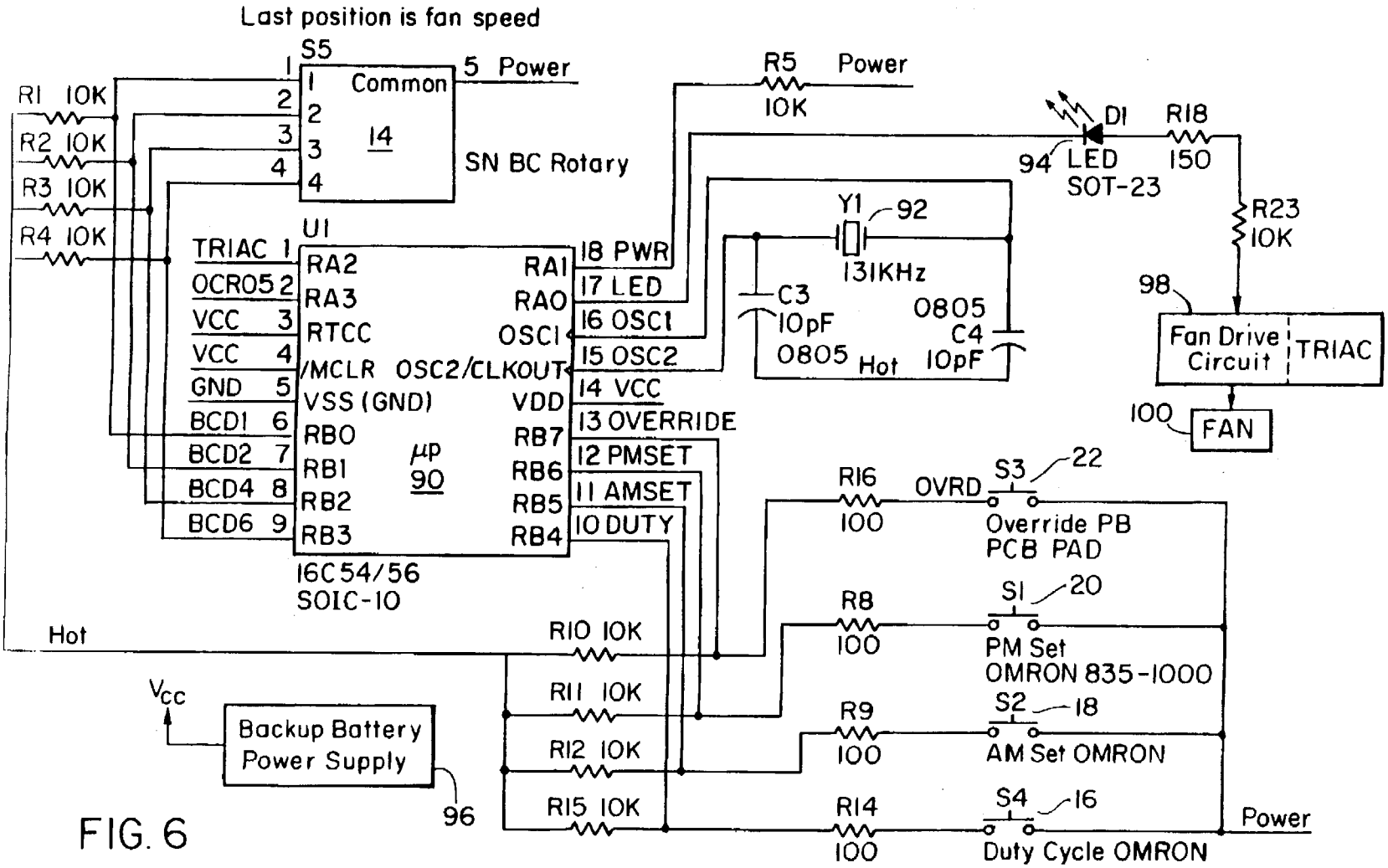
FIG. 6 is a simplified schematic diagram of the ventilation control system according to this invention.
Figure 7:
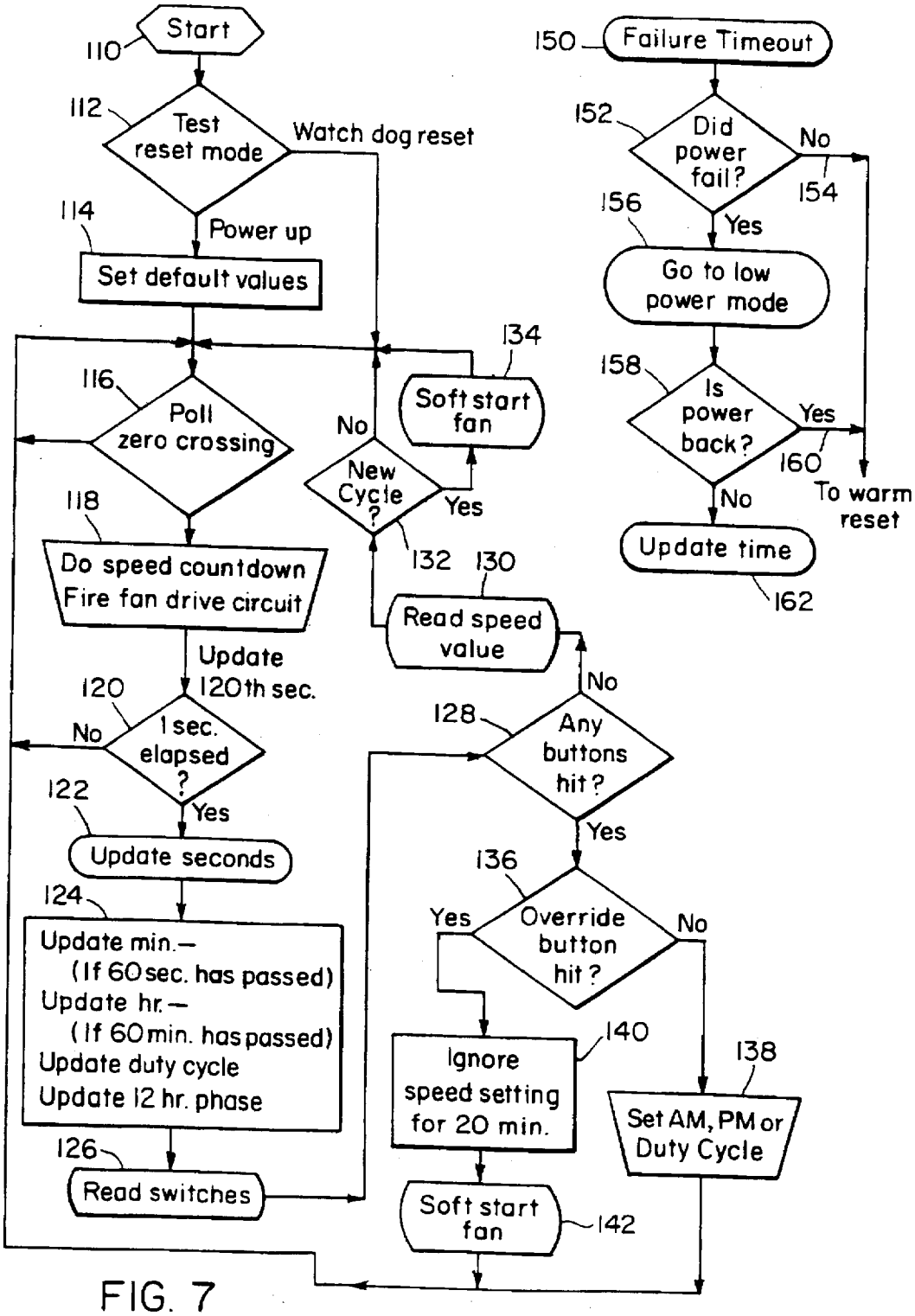
FIG. 7 is a flow chart showing the programming of the microprocessor in FIG. 6.

Manual override switch 22 may include a silicon rubber element 80, FIG. 4, with one or more carbon buttons 82, 84. When a force is exerted in the direction of arrow 86 on element 80, one or both of carbon disks is brought down to complete a circuit on circuit board 62. For example, as shown in FIG. 5, the foil 88 on the circuit may have two breaks in it, one corresponding to carbon disk 84, the other corresponding to carbon disk 82, so that if either one of the carbon disks is brought down to contact them a short is made across legs 90 or across legs 92 to complete the circuit. The circuits implemented by override switch 22, PM set switch 20, AM set switch 18, and duty cycle set switch 16, FIG. 7, are implemented by microprocessor 90 such as a Microchip Technologies, Inc. 16LC54A-04. Microprocessor 90 also is connected with sixteen-position switch 14. The system clock is provided by 131.072 KHz crystal oscillator 92 and an LED 94 may be used to provide a soft backlight through the translucent silicone material of manual override switch 22. A backup battery power supply 96 maintains power to microprocessor 90 so that even during power failures when the fan may not be operated the settings of time, duty cycle and speed will be preserved, to be reapplied once the power returns. The output from microprocessor 90 is delivered to fan drive circuit 98 which in turn drives a fan 100. Microprocessor 90 may be implemented with a Microchip Technologies, Inc. 16LC54A-04.

Microprocessor 90 is programmed in accordance with the flow chart of FIG. 7. Initially in step 110 the system is started and moves into the test reset mode, step 112. The system is powered up and default values are set in step 114. For example, the time default is 6 PM or 12 AM and the duty cycle is set at five minutes per hour. The system now begins to monitor zero crossings as the AC power wave crosses the zero line twice each cycle or 120 times each second for a sixty cycle power supply. The zero crossings are polled or counted, step 116, each time the sixty-cycle power supply goes through zero. Normally in step 118 a speed countdown is executed, as will be explained further, but since this is the startup phase the fan drive circuit 98, which may for example be a TRIAC, is given power to start the fan motor and overcome the normal inertia. Then inquiry is made in step 120 as to whether one full second has elapsed. If not, the system recycles and goes back to the poll zero crossing step 116 and through the firing at full speed 118 of the fan drive circuit. This is so to ensure that at least for one second full power is applied to the fan motor to get it moving. After the one second has elapsed, however, the system record is updated for seconds in step 122. Then in step 124 if sixty seconds have passed the minutes are updated, and if sixty minutes have passed the hour count is updated. The duty cycle is now checked to see if the same duty cycle is still being requested and the 12 hour period selected for operation (provided it was the twelve-hour and not the 24 hour period selected) is checked to see if that is still the same. This occurs every second throughout operation.

At this time also the system checks to see if the prescribed duty cycle has been accomplished in this hour and whether it is still in the 12 hour period selected for operation. At this point in the initial setup at step 126 the switch settings are read for duty cycle and time of day entered by the installer so that the default values assumed in step 114 are no longer used. The question is then asked in step 128 whether any buttons have been hit. If not the speed value is read from multiposition switch 14, step 130, and inquiry is made in step 132 as to whether this is a new cycle. If it is not, the system simply returns to step 116 and polls for the next zero crossing. If it is new cycle, a soft start command is given in step 134 for example, whereby the system will start at a given fan speed slower than the selected one and move slowly toward the selected one. For example, if the ultimate selected speed is 3, as appears on multiposition switch 14, FIG. 1, the system may start at speed 11 and step its way up to speed 3 to ensure a smooth, quiet fan start without noise or vibration. If, alternatively, in step 128 a button has been hit, inquiry is made in step 136 as to whether it was the override button. If it was not, then the setting is accepted in step 138 for the time, AM or PM, or the duty cycle, and the system then returns to count the next zero crossing in step 116. If the override button was hit the system is commanded to ignore the speed setting in step 140 for some predetermined period of time, for example twenty minutes, and a soft start is again executed in step 142 to bring the fan motor up to the desired speed gently and quietly. The system then returns to count the next zero crossing in step 116. If during operation a failure timeout occurs as shown in block 150, inquiry is then made in step 152 as to whether the power failed. If it did not fail the system assumes that it was a minor problem and provides a reset signal on line 154 and recycles the system to begin counting the next zero crossing at step 116. If the power did fail then the system is sent into the low power mode at step 156 to conserve battery power and maintain the settings for duty cycle, speed and time. When the power comes back, as is recognized in step 158, the system sends a command on line 160 to recycle the operation to step 116 where the zero crossing is counted and normal operation is resumed. If the power has not come back then the time is updated in step 162 and the system is cycled back to step 158 where the question of whether the power is back is repeated.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An automatic program ventilation control system for operating a fan comprising:

a fan drive circuit;

a duty cycle control circuit including means for selecting a duty cycle and means for setting the selected duty cycle, wherein said duty cycle is a specified length of time within a specified time interval;

a timing circuit including means for selecting a time of day and means for setting the selected time of day;

a fan speed control circuit including means for selecting a fan speed and means for setting the selected fan speed;

a manual override switch circuit for overriding the set duty cycle and fan speed for operating the fan at a predetermined speed for a preselected period of time; and a control panel wherein each of said means for setting and said means for selecting are accessible on said panel, said panel including means for mounting a switch cover plate which covers and makes inaccessible said panel.

2. The automatic programmed ventilation control system of claim 1 in which said means for selecting a duty cycle, means for selecting the time of day, and means for selecting a fan speed all include a multiposition switch device.

3. The automatic programmed ventilation control system of claim 1 in which said manual override switch circuit includes an override switch.

4. The automatic programmed ventilation control system of claim 3 in which said override switch is accessible through said switch cover plate.

5. The automatic programmed ventilation control system of claim 1 in which said fan drive circuit includes a soft start circuit for incrementally increasing the fan speed to the selected speed.

6. The automatic programmed ventilation control system of claim 1 further including a battery backup power supply for maintaining the selected duty cycle, speed and time in case of power failure.

* * * * *